US006505425B1

(12) United States Patent
Gilbert

(10) Patent No.: US 6,505,425 B1
(45) Date of Patent: Jan. 14, 2003

(54) FLORAL CONTAINER

(76) Inventor: Scott Gilbert, 22360 Royalton Rd., P.O. Box 360050, Strongsville, OH (US) 44136

( * ) Notice: Subject to any disclaimer, the term of this patent is extended or adjusted under 35 U.S.C. 154(b) by 0 days.

(21) Appl. No.: 09/577,460

(22) Filed: May 24, 2000

Related U.S. Application Data

(60) Provisional application No. 60/135,464, filed on May 24, 1999.

(51) Int. Cl.[7] ..... G09F 3/04
(52) U.S. Cl. ..... 40/306; 40/299.01; 47/72
(58) Field of Search ..... 47/72; 493/187, 493/188; 40/594, 615, 675, 299.01, 674, 306

(56) References Cited

U.S. PATENT DOCUMENTS

| | | | | | |
|---|---|---|---|---|---|
| 4,413,725 | A | * | 11/1983 | Bruno et al. | 47/72 X |
| 4,801,014 | A | | 1/1989 | Meadows | 206/423 |
| 5,293,715 | A | * | 3/1994 | Kaz | 47/72 X |
| 5,388,695 | A | | 2/1995 | Gilbert | 206/423 |
| 5,496,252 | A | | 3/1996 | Gilbert | 493/224 |
| 5,575,096 | A | * | 11/1996 | Allegre | 40/306 |
| 5,606,845 | A | | 3/1997 | Weder | 53/411 |
| 5,647,168 | A | | 7/1997 | Gilbert | 47/72 |
| 5,687,845 | A | * | 11/1997 | Weder | 47/72 X |
| 5,899,047 | A | * | 5/1999 | Weder et al. | 206/423 |
| 6,061,955 | A | * | 5/2000 | Domstein | 47/72 X |
| 6,129,208 | A | * | 10/2000 | Ferguson | 47/72 X |
| 6,183,590 | B1 | * | 2/2001 | Weder | 47/72 X |
| 6,185,904 | B1 | * | 2/2001 | Weder et al. | 47/72 X |
| 6,318,050 | B1 | * | 11/2001 | Weder | 53/399 |
| 6,327,801 | B1 | * | 12/2001 | Witkowski | 40/306 |

* cited by examiner

*Primary Examiner*—D. Glenn Dayoan
*Assistant Examiner*—Jason Morrow
(74) *Attorney, Agent, or Firm*—Gordon D. Kinder, Renner, Otto, Boisselle & Sklar, LLP

(57) ABSTRACT

A floral container including receptacle-forming panels joined together to form a receptacle for a flower bouquet, a potted plant, or other plants and one or more panels panel removably joined to one of the receptacle-forming panels. The removable panel(s) may include indicia corresponding to a special holiday, such as Valentine's Day, whereby after the holiday it may removed and the container salvaged for everyday use. Alternatively, the removable panel(s) may include a coupon for removal by a purchaser, price/inventory information for removal by a retailer, or plant care instructions for removal by a recipient. Still further, the removable panel(s) may conceal indicia on the receptacle-forming panels, this indicia being revealed once the removable panel is removed.

46 Claims, 5 Drawing Sheets

FLORAL CONTAINER

RELATED APPLICATIONS

This application claims priority under 35 U.S.C. §119(e) to U.S. Provisional Patent Application No. 60/135,464 filed on May 24, 1999. The entire disclosure of this earlier application is hereby incorporated by reference.

FIELD OF THE INVENTION

The present invention relates generally as indicated to a floral container and more particularly to a floral container including one or more removable panels bearing, for example, a holiday message/indicia, coupon items, and/or bar code.

BACKGROUND OF THE INVENTION

A floral item, such as a bouquet of flowers or potted plant, is typically purchased at a floral shop or stand. A bouquet is usually presented to the purchaser in a container that forms a receptacle for the flower's stems and perhaps a protective covering for the flower's buds and blooms. A potted plant may be presented in a container that covers the pot and perhaps provides a protective covering for the plant's buds and blooms. The container may comprise receptacle-forming panels joined together to form a frustoconical shape when in an expanded state to hold the flower bouquet and to lay flat against each other in a collapsed state so that they may be compactly stored until ready for use. The receptacle-forming panels may include, for example, front and rear trapezoidal panels joined together along their slanted lateral edges by an essentially permanent and preferably water impervious seam.

A floral item, such as a bouquet of flowers or a potted plant, is a popular gift of choice for a variety of everyday occasions, personal celebrations, and special holidays. For everyday occasions and personal celebrations (such as birthdays and anniversaries) the purchase date depends on the person being given the gift. However, special holidays, such as Valentine's Day, Mother's Day, and Sweetest Day, represent opportunities to sell a large quantity of flowers on particular dates. Accordingly, peaks in purchases in the floral industry sales correspond to special holidays.

The floral industry increases its inventory to accommodate special holiday purchase peaks and typically provides floral containers decorated for the special holiday. While these special indicia are quite popular and in demand for the holiday, once the special holiday is past, the specially decorated bouquet containers lose much of their value. For example, a Valentine's Day decorated floral container will not have much appeal on February $15^{th}$, the day after Valentine's Day. Accordingly, the florist is forced to either store the excess floral containers for an entire year (usually not an attractive option in view of inventory concerns) or simply scrap the special holiday containers.

Additionally or alternatively, when a floral item is sold in certain settings, it is sometimes necessary or desirable for the container to bear certain information. Some types of information need not be conveyed to an ultimate recipient of a floral gift. For example, it may be desirable to include a coupon on the container to create multiple sales, cross market certain merchandise and/or generate repeat sales. Also, in most retail settings, a bar code conveying price and inventory information must be included somewhere on the container. Other types of information, such as perhaps plant or flower care, should be conveyed to an ultimate recipient but need not remain on the container indefinitely. Further, in certain situations, in may be desired for certain information to remain concealed until a later time.

SUMMARY OF THE INVENTION

The present invention provides a floral container comprising receptacle-forming panels joined together to form a receptacle for a flower bouquet or other plants and one or more panels removably joined to one of the receptacle-forming panels so that it may be selectively removed from the receptacle.

The removable panel may include indicia corresponding to a special holiday, such as Valentine's Day in which case the preferred method of doing business includes removing the panel after the holiday and prior to the purchaser receiving the bouquet. Alternatively, the removable panel may include a coupon for removal by a purchaser, price/inventory information for removal by a retailer, and/or plant care instructions for removal by a recipient.

These and other features of the invention are fully described and particularly pointed out in the claims. The following descriptive annexed drawings set forth in detail certain illustrative embodiments of the invention, these embodiments being indicative of but a few of the various ways in which the principles of the invention may be employed.

DRAWINGS

DETAILED DESCRIPTION

Figure 1:
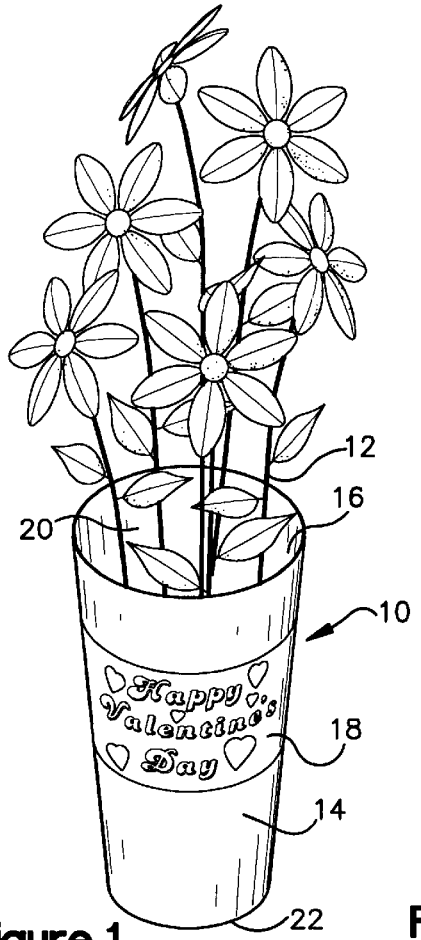
FIG. 1 is a perspective view of a floral container according to the present invention, the container being used as a receptacle for a flower bouquet and including a removable panel having indicia corresponding to a special holiday.
Figure 2:
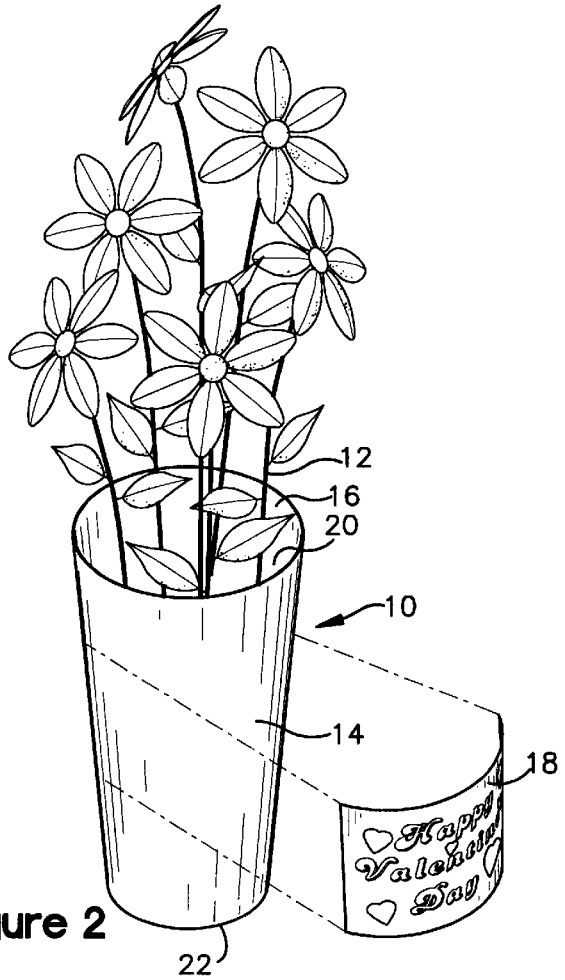
FIG. 2 is a perspective view of the floral container with the removable panel removed.

Referring now to the drawings, FIG. 1 shows a container 10 for a bouquet of flowers 12 according to the present invention. The container 10 includes panels 14 and 16 which form a receptacle for the bouquet of flowers 12 and a panel 18 removably secured to the panel 14. In the illustrated embodiment, the panel 18 includes indicia corresponding to a special holiday, namely Valentine's Day, and may be selectively removed as shown in FIG. 2 once the holiday is over. In this manner, the floral container 10 may be salvaged for everyday use by, in the preferred method of doing business, the removable panel 18 being removed after the holiday and prior to the purchaser receiving the bouquet of flowers 12.

In the illustrated floral container 10, the receptacle-forming panels 14 and 16 form a frustoconical shape when expanded to hold the flower bouquet 12. In this manner, the container 10 forms a receptacle for the flowers's stems and, depending on the height of the receptacle and flowers, also a protective covering for the flowers's buds and blooms. The floral container 10 includes an open top 20 for insertion of the bouquet of flowers 12 and an open bottom end 22. Alternatively, the bottom end 22 may be modified to form a closed bottom if necessary or desired.

Figure 3:
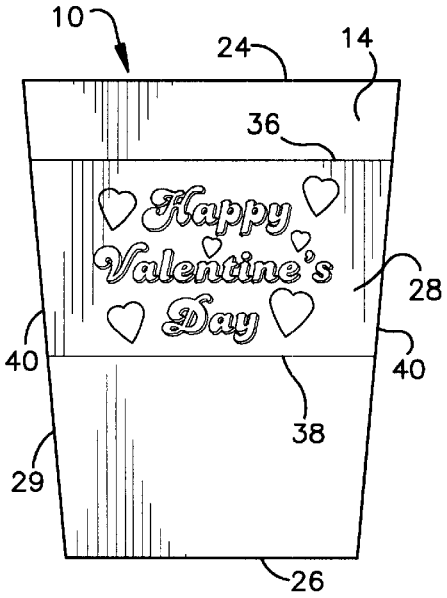
FIG. 3 is a front view of the floral container in a flattened condition.
Figure 4:
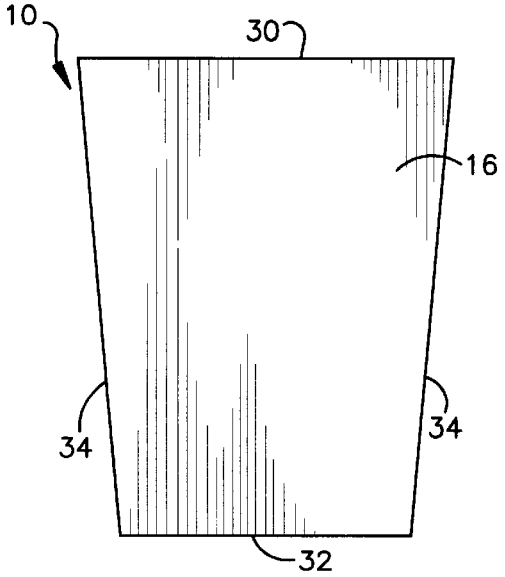
FIG. 4 is a back view of the floral container in a flattened condition.

When the container 10 is in a flattened or collapsed state, as is shown in FIGS. 3 and 4, the panels 14 and 16, and also the removable panel 18 lay flat against each other so that they may be compactly stored until ready for use. The panels 14 and 16 are each in the shape of a trapezoid, that is a quadrilateral having two parallel upper and lower sides (with the lower side being shorter than the upper side) and the remaining two lateral sides being equally angulated but oppositely directed. The panel 18 is also in the shape of a trapezoid, its sides being shorter than, but similarly angulated to, the corresponding sides of the panels 14 and 16.

Although the illustrated panels 14, 16, and/or 18 are trapezoidal, other shapes and geometries are possible with and contemplated by the present invention. For example, the receptacle-forming panels 14 and 16 could be square, rectangular, or any other shape capable of forming a receptacle. The removable panel 18 could also be square or rectangular and/or contain curved or undulate edges for decorative purposes. Furthermore, the removable panel 18 could be cut in a decorative form for the purposes of a particular holiday, such as heart-shape (for Valentine's Day and Sweetest Day) or a tree-shape (for Christmas). Additionally or alternatively, the receptacle-forming panels 14 and 16 could have removable top portions to accommodate, for instance, a potted plant.

The panel 14 includes a top edge 24, a bottom edge 26 and lateral edges 28 and 29, and the panel 16 includes a top edge 30, a bottom edge 32, and lateral edges 34 and 35. The lateral edges 28 and 29 of the panel 14 and the lateral edges 34 and 35 of the panel 16 are joined together by an essentially permanent seam, preferably impervious to water, to form the receptacle. In the context of the present invention, an "essentially permanent seal" refers to a heat-seal, weld, or any other appropriate type of seam which cannot be disrupted without damaging the film adjacent the weld or without incurring a high risk of doing so. The bottom edge 26 of the panel 14 and the bottom edge 32 of the panel 16 may be similarly joined together by such a seam if it is desired for the container 10 to have a closed bottom.

The removable panel 18 includes a top edge 36, a bottom edge 38 and lateral edges 40. The lateral edges 40 of the panel 18 are joined to the intermediate sections of the lateral edge 28 of the panel 14 by a disruptable seam. In the context of the present invention, a "disruptable seam" refers to a seam which is made without welding one surface to the other and/or which can be disrupted with little effort, for example, by tugging on the top edge of the panel 18 or by inserting a finger between the seam, without damaging material adjacent to the seam. In this manner, the panel 18 may be selectively removed from the panel 14 and the container 10 salvaged for use without the panel 18.

The receptacle-forming panels 14 and 16 may be transparent, translucent, or opaque and/or printed or plain. They are preferably made from a film that is, for example, 0.5 mil to 8 mil thick. The receptacle-forming panel 14 and/or panel 16 may be treated (i.e., printed) with a high-gloss ink on one surface, these treated surfaces preferably forming the interior of the container 10. The removable panel 18 is also preferably made from a film that is preferably 0.5 mil to 8 mil thick and that may or may not be transparent. The film for the panel 18 is further selected so that it can be easily printed with varying thicknesses of colored inks and/or metal inks as is desired to create the special holiday decoration or other indicia. Suitable films include polyolefins (particularly polyethylene and polypropylene), polyesters (particularly polyethylene-terephthalate), and nylons.

Figure 5A:
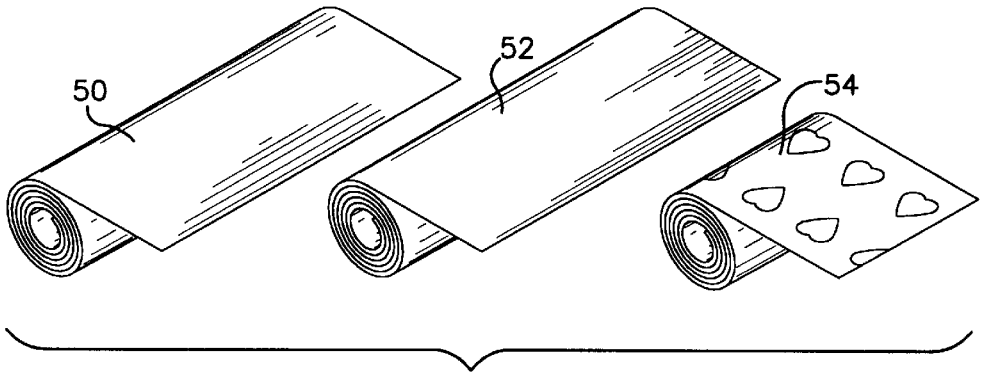
FIGS. 5A–5C are schematic illustrations of a method of making a series of floral containers.

In a preferred method of making the floral container 10, three webs 50, 52 and 54 are provided, the webs 50 and 52 being of the selected film for panels 14 and 16 and the web 54 being of the selected film for panel 18. (FIG. 5A.) The webs 50 and 52 are of the same width. The web 54 is of a lesser width than the webs 50 and 52 and printed with the desired indicia which is the Valentine's Day decorations in the illustrated embodiment. The webs 50 and 52 preferably each have a treated (i.e., printed) surface and an untreated surface. The web 54 preferably has at least one treated side and, if the removable panel 18 is to contain curved or undulate edges, or is to have a decorative profile (such as a heart or tree), the web 54 would be contoured to correspond to this geometry.

The webs 50 and 52 are positioned to overlay each other with their treated surfaces facing each other. The web 54 is centrally positioned between the longitudinal edges of the webs 50 and 52 with its untreated surface facing the web 50. (FIG. 5B.)

The webs 50, 52 and 54 are then intermittently advanced, in timed sequence, to sealing stations whereat hot wires (or hot dies) simultaneously form seal seams 60 (adjacent pairs of seams 60 being slanted in opposite directions corresponding to the desired trapezoidal shape of the receptacle-forming panels 14 and 16) and divide the webs into a plurality of containers 10. These containers 10 are collected in a mass, typically in a "pack" in which the containers 10 are similarly aligned and stacked for use by a florist shop or stand. (FIG. 5C.)

The heating sealing operation forms essentially permanent seams 60 between webs 50 and 52 and disruptable seams 62 between webs 50 and 54. In this manner, the lateral edges of the panels 14 and 16 are joined together by an essentially permanent seam to form the receptacle and the removable panel 18 is joined to this receptacle by a disruptable seam whereby it may be selectively removed from the panel 14. Further details of suitable methods for effecting such essentially permanent and disruptable seams are disclosed in U.S. Pat. No. 5,647,168, the entire disclosure of which is hereby incorporated by reference.

Figure 5B:
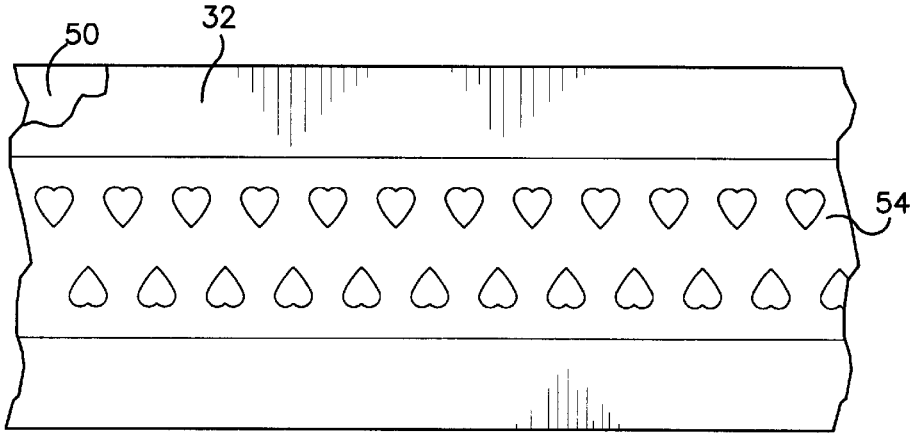
Figure 5C:
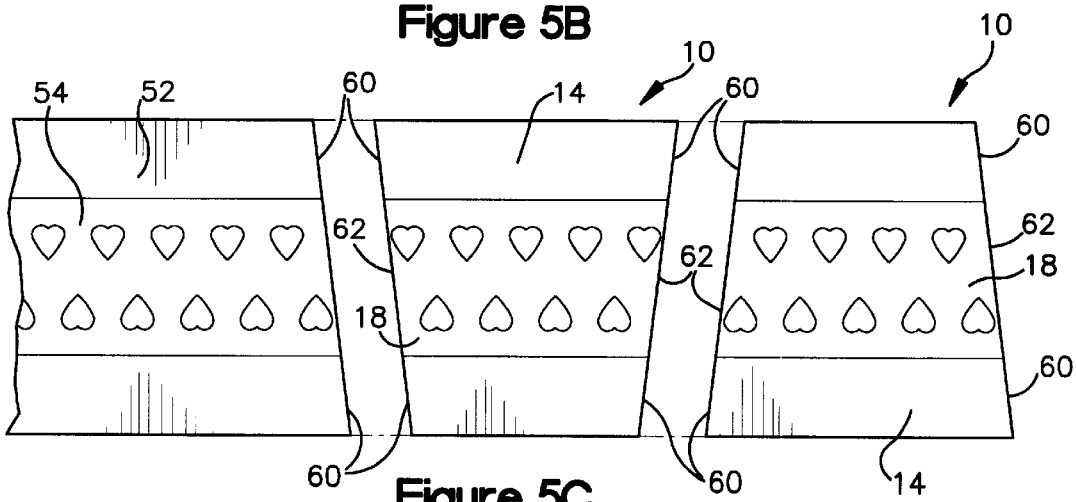

In the method of making the container 10 illustrated in FIGS. 5A–5C, there is little or no waste of material in view of the trapezoidal shape of the panels 14 and 16 and the central location of the panel 18 relative to the panel 14. Specifically, because the web 54 is centrally located, the opposite orientation of the panels (i.e., right-side-up, up-side-down, right-side-up, etc.) does not matter.

Figure 6:
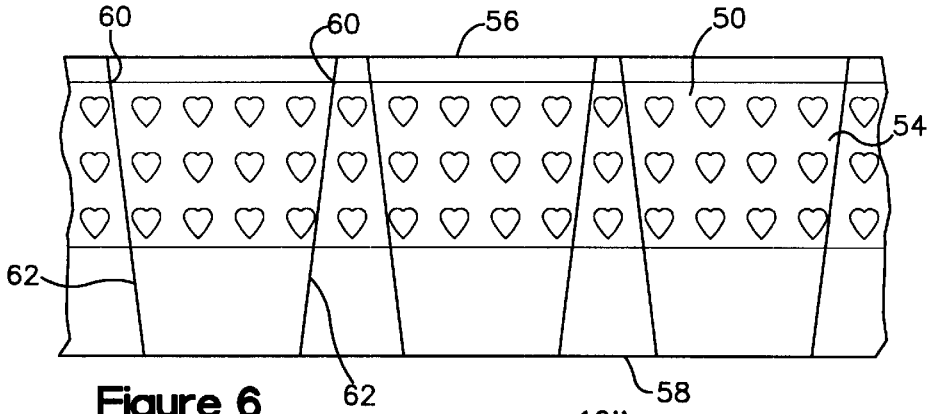
FIG. 6 is a schematic illustration of a modified method of making a series of the floral containers.

If the minimization of waste material is not a priority, the seams 60 and 62 may be arranged in a manner corresponding to all the panels being right-side-up, such as is shown in FIG. 6. The removable panel may then be located at any orientation relative to the panels, such as towards the top edge as shown. This modified method may also be preferred if the container 10 is to have a closed bottom as this could be accomplished by providing a seam between the bottom edges of webs 50 and 52. Alternatively, a single web could be folded over to form the webs 50 and 52 in which case a bottom seam would not be required for a closed bottom container.

Figure 7:
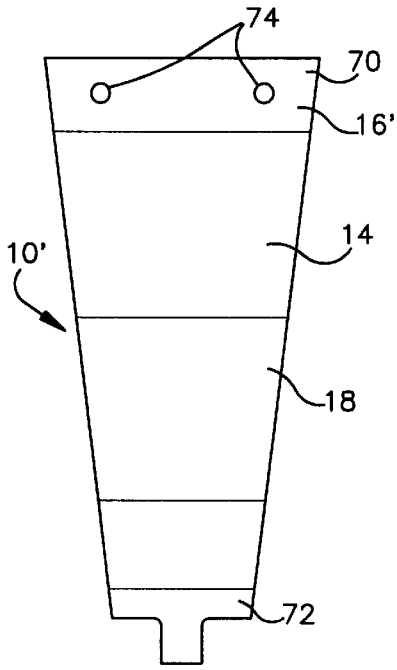
FIG. 7 is a front view of a modified floral container in a flattened condition.

In the above-discussed embodiments of the invention, the panels 14 and 16 have essentially the same trapezoidal shape. However, modifications to the panel geometry is possible with, and contemplated by, the present invention. For example, as is shown in FIG. 7, a modified container 10' could include a panel 16' having a top tab 70 and a bottom tab 72. The top tab 70 is designed to extend above the top edge of the panel 14 and includes a series of openings 74 to accommodate a dispensing stand or wicket at the florist shop or stand. The bottom tab 72 is designed to be tucked behind the bottom edges of the panel 14 to form a semi-closed bottom for the container 10'.

Figure 8:
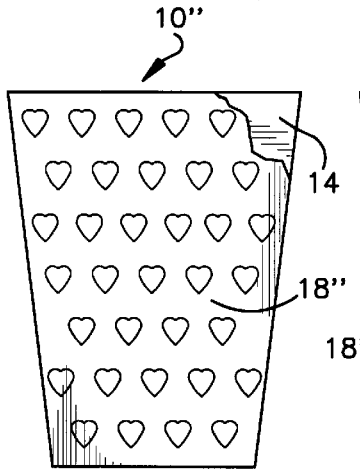
FIG. 8 is a front view of another modified floral container in a flattened condition.
Figure 9:
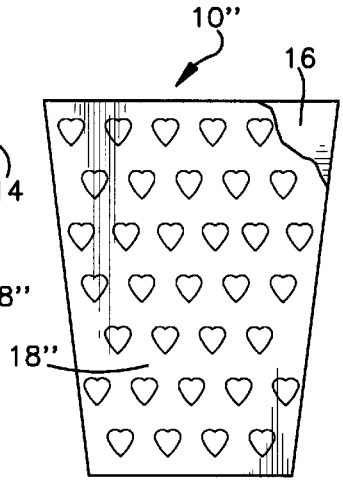
FIG. 9 is a rear view of the floral container of FIG. 8.
Figure 10:
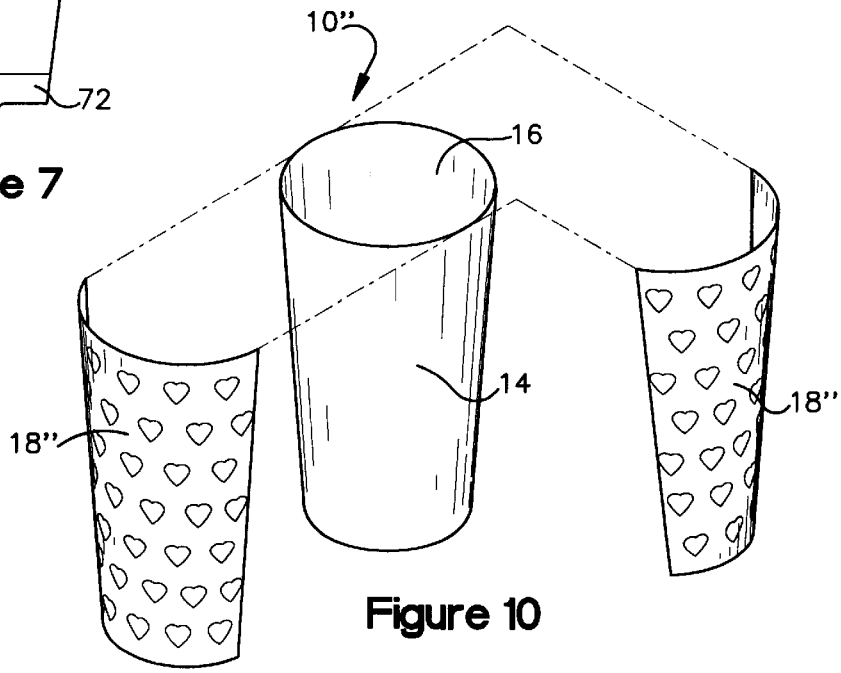
FIG. 10 is a perspective view of the floral container of FIGS. 8 and 9 with its removable panels removed.

For another example, as is shown in FIGS. 8–10, a modified container 10" could include two removable panels 18" and/or the removable panel(s) could cover the entire panel 14/16. Such a design could be used with, for instance, removable panels 18" having a certain color corresponding to the special holiday (such as red or pink for Valentine's day, green for Saint Patrick's Day, etc.). Once the holiday is over, selective removal of the panels 18" would result in a once again neutral receptacle.

Figure 11:
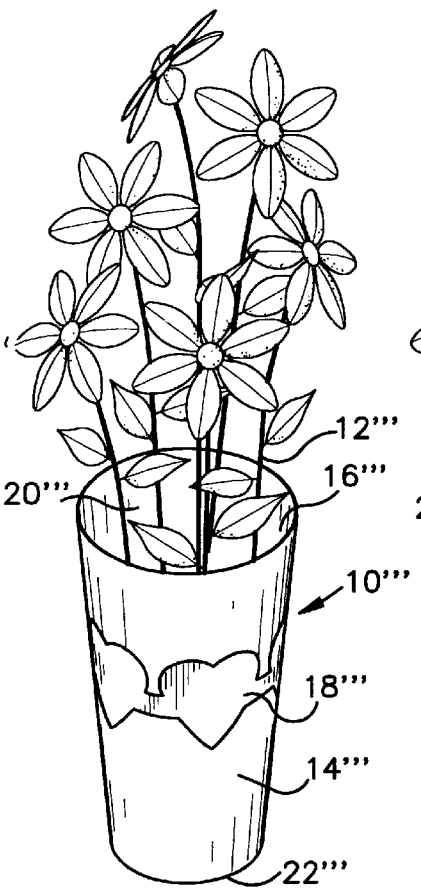
FIG. 11 is a perspective view of a floral container according to the present invention, the removable panel having non-linear edges forming a contoured profiled corresponding to a certain holiday.

For a further example, as is shown in FIG. 11, a modified container 10" could include a non-linear edge panels 18" reflecting a shape corresponding to the special holiday, such as heart-shaped for Valentine's day, clover-shaped for Saint Patrick's Day, etc. Once the holiday is over, selective removal of the panels 18" would result in a once again neutral receptacle.

Figure 14:
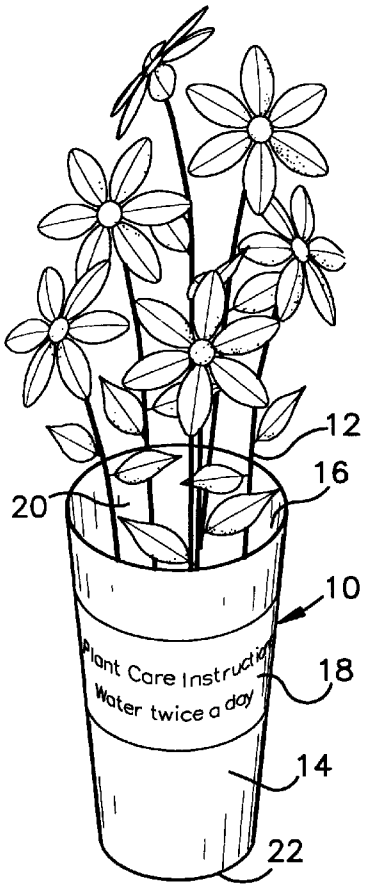
FIG. 14 is a perspective view of a floral container according to the present invention, the removable panel including plant care instructions for removal by a recipient.
Figure 13:
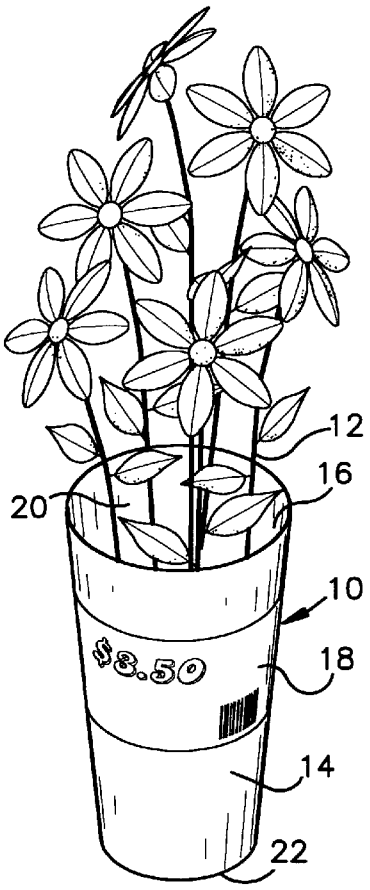
FIG. 13 is a perspective view of a floral container according to the present invention, the removable panel including price/inventory information for removal by a retailer.
Figure 12:
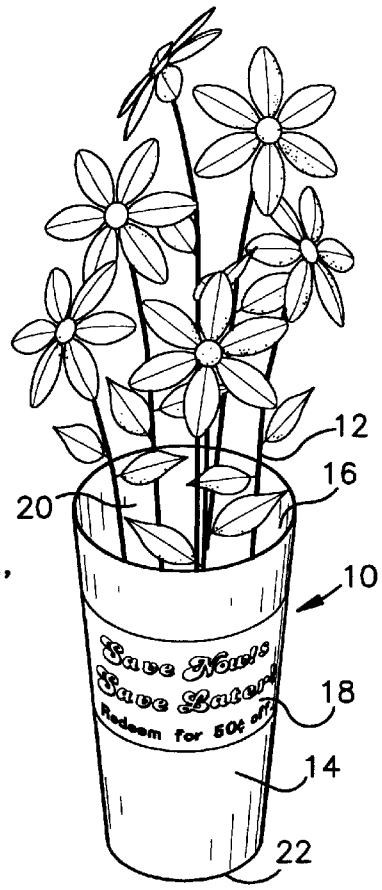
FIG. 12 is a perspective view of a floral container according to the present invention, the removable panel including a coupon for removal by a purchaser.
Figure 15:
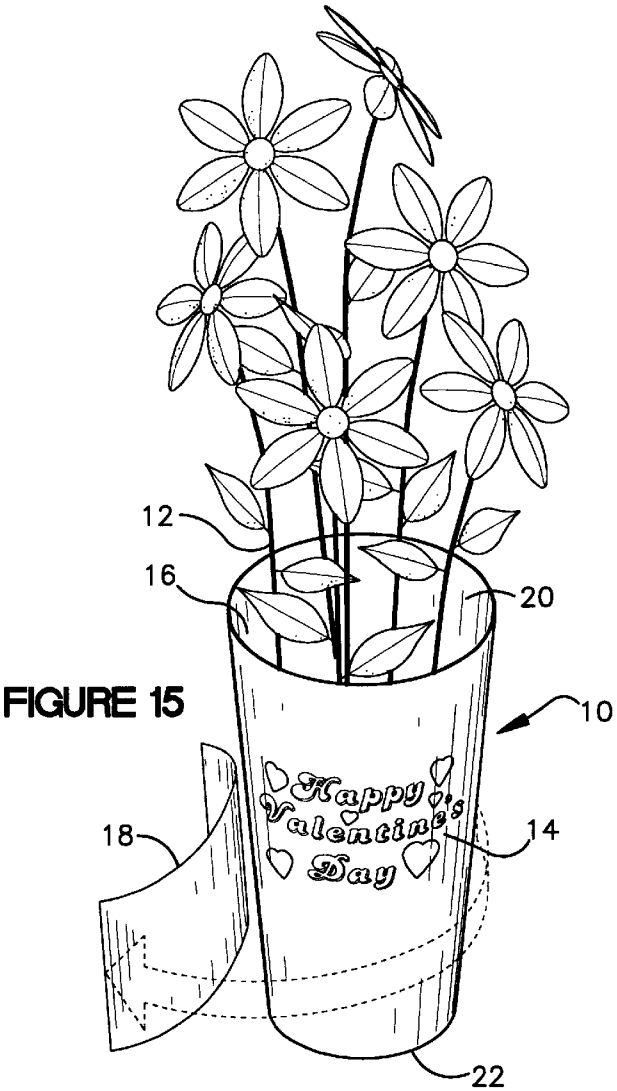
FIG. 15 is a perspective view of a floral container according to the present invention, with the removable panel removed to reveal indicia on the receptacle-forming panel.

While the illustrated panel 18 includes holiday indicia, other uses for the removable panel 18 are possible with and contemplated by the present invention. By way of example, the panel 18 could include a coupon for removal by a purchaser. (FIG. 12.) By way of another example, the panel 18 could include price/inventory information, such as a bar code, for removal by a retailer. (FIG. 13.) By way of a further example, the panel 18 could include plant care instructions (e.g., watering recommendations) for removal by a recipient. (FIG. 14.) Also, instead of the indicia or information being on the removable panel 18, it could be on one of the receptacle-forming panels 14 and revealed once the removable panel is removed. (FIG. 15.)

Figure 16:
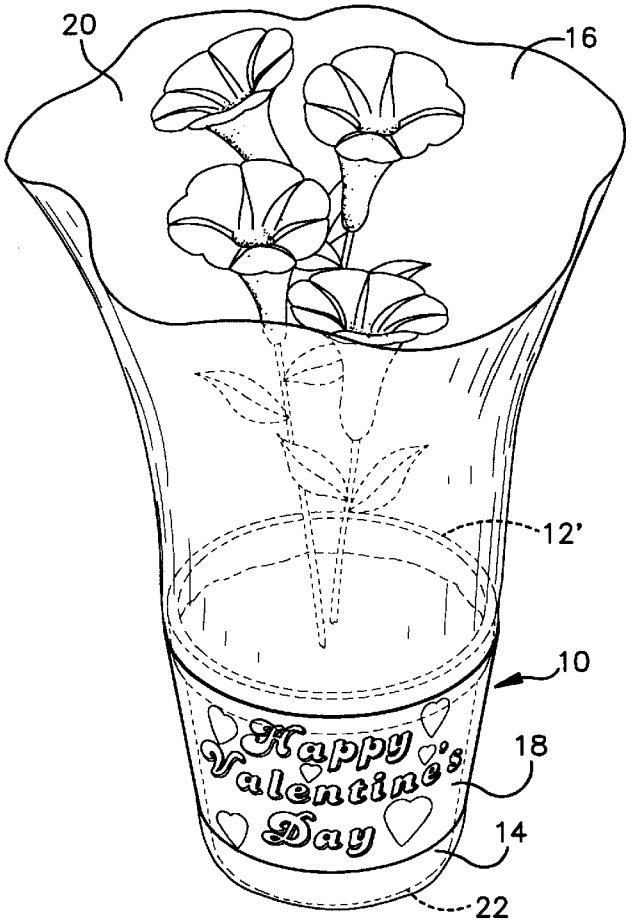
FIG. 16 is a perspective view of the floral container according to the present invention being used as a receptacle for a potted plant and including a removable panel having indicia corresponding to a special holiday.

Additionally or alternatively, the container 10 could be used as a receptacle for a potted plant 12' as shown in FIG. 16. Moreover, the container 10 could be used a receptacle for non-plant and non-floral items such as candy, food, tools, toys, toiletries, and other items.

Although the invention has been shown and described with respect to certain preferred embodiments, it is obvious that equivalent and obvious alterations and modifications will occur to others skilled in the art upon the reading and understanding of this specification. The present invention includes all such alterations and modifications and is limited only by the scope of the following claims.

What is claimed is:

1. A floral container comprising:

at least two receptacle-forming panels having opposed lateral edges joined together to form a receptacle to receive flowers or other plants; and a removable panel having opposed lateral edges, a top edge, and a bottom edge, at least one of the lateral edges of the removable panel at least paritally overlapping and being removably joined to one of the lateral edges of the receptacle-forming panels so that the removable panel may be selectivley removed from the receptacle.

2. A floral container as set forth in claim 1, wherein the removable panel includes indicia corresponding to a special holiday, a coupon, price/inventory information, a bar code, and/or care instructions.

3. A floral container as set forth in claim 1, wherein the removable panel conceals indicia on the receptacle-forming panels.

4. A floral container as set forth in claim 1, wherein the removable panel has linear top and bottom edges.

5. A floral container as set forth in claim 1, wherein the removable panel has non-linear top and bottom edges forming a contoured profile.

6. A floral container as set forth in claim 1, comprising multiple removable panels removable joined to the receptacle-forming panels so that they may be selectively removed from the receptacle.

7. A floral container comprising:

at least two receptacle-forming panels having opposed lateral edges joined together to form a receptacle to receive flowers or other plants; and a removable panel having opposed lateral edges, a top edge, and a bottom edge, at least one of the lateral edges of the removable panel being removably joined to one of the lateral edges of the receptacle-forming panels so that the removable panel may be selectively removed from the receptacle; and wherein the receptacle-forming panels and the removable panel lay flat against each other when the container is in a collapsed state whereby they may be compactly stored until ready for use.

8. A floral container as set forth in claim 7, wherein the receptacle forming panels form a frustoconical shape when expanded to hold the floral item.

9. A floral container as set forth in claim 8, wherein the receptacle forming panels comprise a front panel and a back panel and wherein corresponding lateral edges of the front and back panels are joined together by an essentially permanent seam.

10. A floral container as set forth in claim 9, wherein the front panel and the back panel each have a quadrilateral shape and wherein the removable panel also has a similarly angulated quadrilateral shape.

11. A floral container as set forth in claim 10, wherein the lateral edges of the removable panel are joined to corresponding lateral edges of the front panel by disruptable seams.

12. A floral container as set forth in claim 10, wherein the removable panel is centrally located relative to the top edge and the bottom edge of the front panel.

13. A floral container as set forth in claim 10, wherein the quadrilateral shape of the front panel, the back panel and the removable panel is a trapezoidal shape.

14. A floral container as set forth in claim 1, wherein the receptacle-forming panels and the removable panel comprise a suitable file selected from the group consisting of polyolefins, polyethylene, polypropylene, polysters, polyethylene-terephthalate, and/or nylons.

15. A floral container as set forth in claim 1, wherein the receptacle-forming panels include a top tab adapted to accommodate a dispensing stand.

16. A floral container as set forth in claim 15, wherein the rear panel includes the top tab and it extends above the top edge of the front panel and includes openings to accommodate a dispensing stand.

17. A floral container as set forth in claim 1, wherein the container includes an open bottom end.

18. A floral container as set forth in claim 1, wherein the container includes a closed bottom end.

19. A floral container as set forth in claim 18, wherein the receptacle-forming panels include a front panel and a back panel and wherein the back panel has a bottom tab designed to be tucked behind the bottom edges of the front panel to form the container's closed bottom end.

20. A floral container as set forth in claim 1, wherein the receptacle-forming panels comprise a front panel and a back panel, wherein the removable panel is joined to the front panel and wherein the container further comprises another removable panel joined to the back panel so that it may be selectively removed from the receptacle.

21. A floral container as set forth in claim 20, wherein the removable panels substantially cover the front and back panels.

22. A floral container as set forth in claim 1, wherein the removable panel substantially covers the receptacle-forming panel to which it is joined.

23. A series of the floral containers set forth in claim 1, the containers being aligned and stacked in a pack.

24. A series of floral containers as set forth in claim 16, the containers being aligned and hung from a dispensing stand.

25. A method of providing a floral item to a purchaser comprising the steps of:

providing the floral container of claim 1;

inserting a floral item into the receptacle; and removing the removable panel from the receptacle.

26. A method as set forth in claim 25, wherein the removable panel includes indicia corresponding to a special holiday and wherein said removing step is performed after the special holiday and prior to the purchaser receiving the floral item.

27. A method as set forth in claim 25, wherein the removable panel includes a coupon and wherein said removing step is performed by a purchaser.

28. A method as set forth in claim 25, wherein the removable panel includes price/inventory information and wherein said removing step is performed by a retailer.

29. A method as set forth in claim 25, wherein the removable panel includes plant care instructions and wherein said removing step is performed by a purchaser.

30. A method as set forth in claim 25, wherein the floral item is a flower bouquet.

31. A method as set forth in claim 25, wherein the floral item is a potted plant.

32. A method of making a batch of floral containers, each container comprising:

at least two receptacle-forming panels having opposed lateral edges joined together to form a receptacle to receive flowers or other plants; and a removable panel having opposed lateral edges, a top edge, and a bottom edge, at least one of the lateral edges of the removable panel being removably joined to one of the lateral edges of the receptacle-forming panels so that the removable panel may be selectively removed from the receptacle, the method comprising the steps of:

providing a first web and a second web of a film suitable for the receptacle-forming panels and having a width roughly corresponding to a desired height of the receptacle;

providing a third web of a film suitable for the removable panel and have a width corresponding to a desired height of the removable panel;

forming essentially permanent sealing seams between the first and second webs corresponding to the desired shape of the receptacle; and the step of forming disruptable seams between the third web and the first web corresponding to the desired placement of the removable panel relative to the receptacle-forming panels; and dividing the so-seamed webs into the containers.

33. A method as set forth in claim 32, wherein the third web is of a lesser width than the first and second webs.

34. A method as set forth in claim 32, wherein the seam-forming steps are performed by hot wires and/or hot dies.

35. A method as set forth in claim 32, wherein the third web is centrally located relative to the first web during said forming steps.

36. A method as set forth in claim 32, further comprising the step of similarly aligning and stacking the containers to form a pack for use by a florist shop or stand.

37. A method as set forth in claim 32, wherein the seam-forming steps include slanting the essentially permanent seams in opposite directions corresponding to a desired trapezoidal shape of the receptacle-forming panels.

38. A container comprising:

receptacle-forming panels joined together along an opposed pair of edges to form a receptacle; and a removable panel removable joined to at least part of each of the opposed pair of edges of the receptacle-forming panels so that it may be selectively removed from the receptacle.

39. A container as set forth in claim 38, wherein the removable panel includes indicia corresponding to a special holiday, a coupon, price/inventory information, a bar code, and/or care instructions.

40. A container as set forth in claim 38, wherein the removable panel conceals indicia on the receptacle-forming panels.

41. A method of providing an item to a purchaser comprising the steps of:

providing the container of claim 38;

inserting an item into the receptacle; and removing the removable panel from the receptacle.

42. A floral container comprising:

a first receptacle-forming panel and second receptacle-forming panel each having a first and second lateral edge, the first lateral edges and the second lateral edges of the first and second panels being joined together to form side seams of a receptacle to receive flowers or other plants, the first and second receptacle-forming panels having respective top and bottom edges that extend between the respective lateral edges, the top edge of one of the panels extending above and generaly parallel to the top edge of the other panel so as to form a tab for mounting the receptacle; and a removable panel removable joined to the receptacle-forming panels along at least part of the length of one of the side seams so that it may be selectively removed from the receptacle.

43. A floral container as set forth in claim 42 wherein the receptacle-forming panels and the removable panel lay flat against each other when the container is in a collapsed state whereby they may be compactly stored until ready for use.

44. A floral container as set forth in claim 43, wherein the receptacle-forming panels form a frustoconical shape when expanded to hold the floral item.

45. The floral container of claim 42 wherein the side seams joining the first and second panels are essentially permanent seams.

46. The floral container of claim 45 wherein the removable panel is joined to one of the receptacle-forming panels by a disruptable seam.

* * * * *